US006837729B2

(12) United States Patent
Hogue et al.

(10) Patent No.: US 6,837,729 B2
(45) Date of Patent: Jan. 4, 2005

(54) HIGH POWER ELECTRICAL CONTACTOR WITH IMPROVED BRIDGE CONTACT MECHANISM

(75) Inventors: Ronald Lee Hogue, Morrison, IL (US); Hasmukh M. Thekdi, Sterling, IL (US); Michael Gunderson, Morrison, IL (US); Joseph Borrelli, Sterling, IL (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 10/238,211

(22) Filed: Sep. 10, 2002

(65) Prior Publication Data

US 2004/0048521 A1 Mar. 11, 2004

(51) Int. Cl.[7] ..... H01R 13/28

(52) U.S. Cl. ..... 439/289; 439/294; 439/824; 200/243

(58) Field of Search ..... 439/289, 294, 439/824, 700, 246; 200/243, 245, 247, 240

(56) References Cited

U.S. PATENT DOCUMENTS

| | | | | | |
|---|---|---|---|---|---|
| 3,272,949 | A | * | 9/1966 | Lawrence | 200/243 |
| 3,852,544 | A | * | 12/1974 | Grunert et al. | 200/243 |
| 4,216,358 | A | * | 8/1980 | Brozille | 200/240 |
| 4,307,358 | A | * | 12/1981 | Haury et al. | 335/173 |
| 4,401,863 | A | | 8/1983 | Lemmer et al. | 200/16 A |
| 4,421,959 | A | * | 12/1983 | Chen et al. | 200/243 |
| 4,453,057 | A | * | 6/1984 | Streich et al. | 200/243 |
| 4,640,998 | A | * | 2/1987 | Sorenson | 200/240 |
| 4,650,935 | A | | 3/1987 | Ootsuka et al. | 200/16 A |
| 4,947,146 | A | | 8/1990 | Ichimura et al. | 335/131 |
| RE33,457 | E | * | 11/1990 | Ootsuka et al. | 200/240 |
| 5,049,845 | A | * | 9/1991 | Yokoyama et al. | 200/240 |
| 6,084,488 | A | | 7/2000 | Macbeth et al. | 335/132 |
| 6,300,854 | B1 | * | 10/2001 | Oberndorfer | 200/243 |

FOREIGN PATENT DOCUMENTS

| | | | |
|---|---|---|---|
| EP | 1 209 710 A2 | 5/2002 | H01H/51/22 |
| JP | 60-133613 | 7/1985 | H01H/1/18 |

* cited by examiner

*Primary Examiner*—Dean Reichard
*Assistant Examiner*—Angel R. Estrada

(57) ABSTRACT

An electrical contactor assembly is provided that includes a base and power terminals mounted thereto. The power terminals are configured to convey signals. The assembly includes an actuator mounted to the base that moves between initial and final positions along a first direction of motion. The assembly includes a bridge contact supported by the actuator and moved in the first direction of motion. The bridge contact includes contact surfaces on opposite ends thereof aligned with corresponding power terminals. The contact surfaces engage and interconnect the power terminals when the actuator and bridge contact are moved to the final position. The bridge contact moves in a second direction of motion with respect to the actuator. The second direction of motion differs from the first direction of motion during engagement.

17 Claims, 7 Drawing Sheets

HIGH POWER ELECTRICAL CONTACTOR WITH IMPROVED BRIDGE CONTACT MECHANISM

BACKGROUND OF THE INVENTION

The present invention relate to a high power electrical contactor. More specifically, embodiments of the present invention relate to an electrical contactor having improved bridge contact terminals used to carry high current, such as power transformers, water pumps and the like, in heating and air conditioning applications.

Certain electrical applications, such as noted above, utilize electrical contactors having sets of contacts that are normally open (or separated). The contacts are closed (or joined) to supply power to a particular device. For example, an air conditioning unit includes a contactor which has terminals that are oppositely aligned from each other and electrically connected to separate cooling features of the unit. The contactor also includes an actuator holding a bridge contact proximate the terminals in an initial open position. The contactor is electrically connected to a thermostat that sends an electrical signal to the contactor upon reading a predetermined temperature. When the contactor receives the electrical signal, the contactor introduces a magnetic field about the actuator which drives the actuator to a final closed position. In the final closed position, the contact surfaces on the bridge contact engage contact surfaces on the terminals to power the cooling features within the air conditioning unit.

The bridge contact rests on a bridge seat of the actuator which is biased toward the initial open position by a spring. The bridge seat and activator are oriented parallel to the contact surfaces on the terminal, thereby similarly orienting the contact surfaces of the bridge contact parallel to the terminal contact surfaces. This parallel alignment ensures that, as the actuator moves the bridge contacts from the initial open position to the final closed position, the contact surfaces of the bridge contact simultaneously evenly engage the entire contact surfaces of the terminals. Similarly, during disengagement, as the actuator moves the bridge contact away from the contact surfaces of the terminals, the actuator maintains a parallel alignment between the bridge contact surfaces and the terminal contact surfaces. Hence, the contact surfaces of the terminals simultaneously evenly disengage the entire contact surfaces of the bridge contact. The contact surfaces of the bridge contact thus move linearly upward and downward during engagement and disengagement while remaining in the desired parallel alignment with the contact surfaces of the terminals.

However, conventional connectors of the type described above suffer from several drawbacks. In particular, an electrical arc is created between the contact surfaces of a terminal and the contact surface of the bridge contact during engagement. The electrical arc often creates a tack weld between the bridge contact surface and the terminal contact surfaces. The tack weld may be sufficiently strong to overcome the mechanical biasing force continuously induced by the spring. Hence, when the magnetic field closing the contacts is released, the spring is unable to break the tack weld. Hence, the tack weld may prevent the contact surfaces from disengaging from each other even though the spring returns the actuator to the initial open position. Thus, the cooling unit may continue to operate long after the temperature has been satisfactorily reduced. Also, the welded contact surface and contact tip may resist movement of the actuator to the initial open position such that the actuator, bridge contact, or terminals become displaced or damaged. Additionally, even if the contact surface and the contact tip are separated by the movement of the actuator after being welded to each other, the contact surface and contact tip may be damaged and in need of replacement. Therefore, the contact surface and contact tip may require constant monitoring and, when the contact tip and contact surface are welded to each other, the entire contactor needs to be replaced, which consumes time and money.

Therefore, a need exists for a contactor that overcomes the above problems and addresses other concerns experienced in the prior art.

BRIEF SUMMARY OF THE INVENTION

An electrical contactor assembly is provided having a base and power terminals mounted thereto that are configured to convey power signals to a desired application. The electrical contactor assembly includes an actuator movably mounted to the base that moves between initial and final positions along a first direction of motion. The electrical contactor assembly includes at least one bridge contact supported by the actuator and moving in the first direction of motion along with the actuator. The bridge contact includes contact surfaces on opposite ends thereof aligned with corresponding power terminals. The contact surfaces engage and interconnect the power terminals when the actuator and bridge contact are moved to the final position. The actuator and bridge contact interact such that the contact surfaces move with respect to the power terminals in a second direction of motion differing from the first direction of motion during engagement.

In certain embodiments, the electrical contactor assembly includes an actuator that moves between initial and final positions along an actuator axis. The bridge contact includes contact surfaces on opposite ends thereof aligned with corresponding power terminals. The contact surfaces engage and interconnect the power terminals when the actuator and bridge contact are moved to the final position. The actuator and bridge contact interact such that, as the actuator moves along the actuator axis, the contact surfaces move with respect to the power terminals by rotating about a longitudinal axis. During rotation, the contact surfaces roll about the longitudinal axis during engagement with the power terminals.

In certain embodiments, the electrical contactor assembly is provided with at least one bridge contact that is flexible along its longitudinal axis. The bridge contact includes contact surfaces on opposite ends thereof aligned with corresponding power terminals. The contact surfaces engage and interconnect the power terminals when the actuator and bridge contact are moved to the final position. The actuator and bridge contact interact such that the contact surfaces move along a linear translation with respect to each other during engagement with the power terminals as an intermediate portion of the bridge contact flexes upward or downward during engagement.

Figure 1:
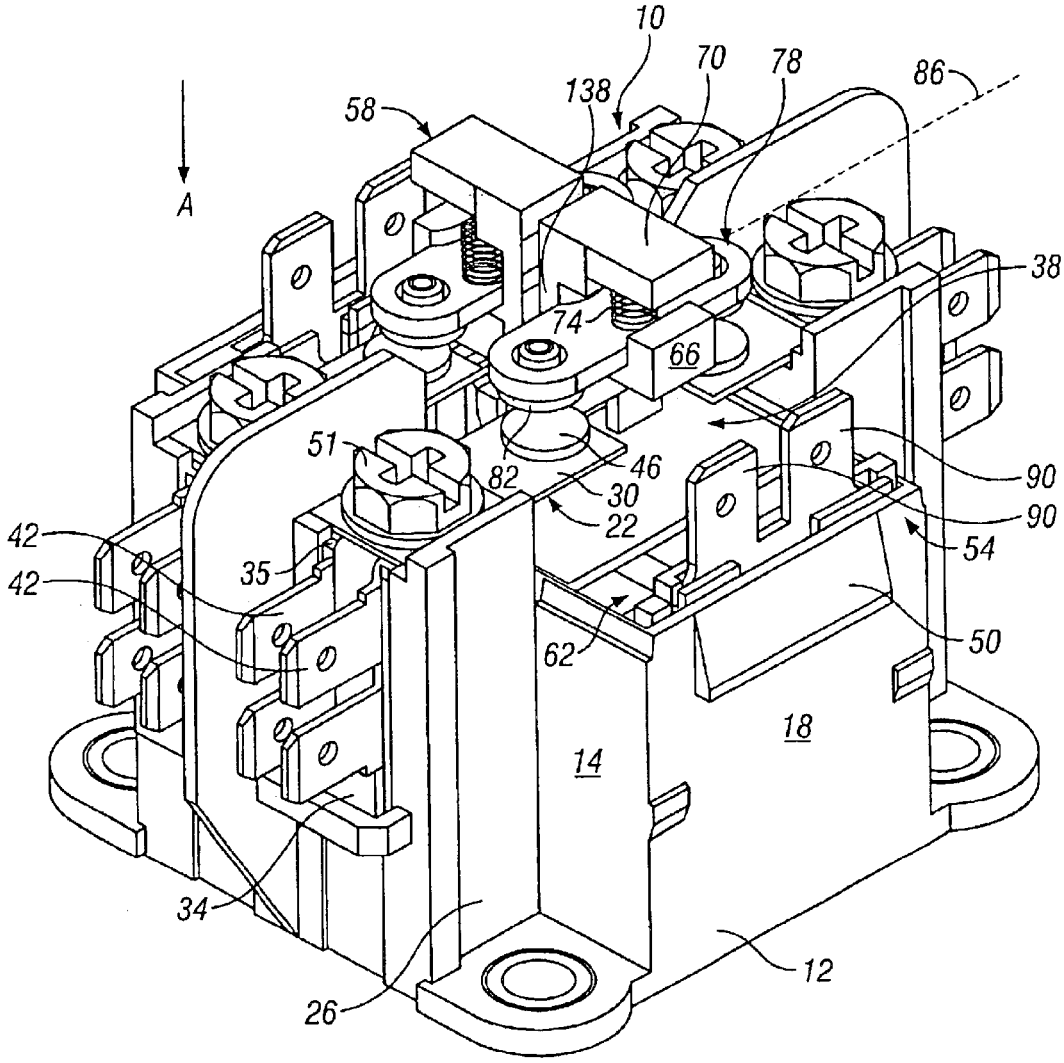
FIG. 1 illustrates an isometric view of an uncovered contactor formed according to an embodiment of the present invention.

The foregoing summary, as well as the following detailed description of certain embodiments of the present invention, will be better understood when read in conjunction with the appended drawings. For the purpose of illustrating the invention, there is shown in the drawings, certain embodiments. It should be understood, however, that the present invention is not limited to the arrangements and instrumentality shown in the attached drawings.

DETAILED DESCRIPTION OF THE INVENTION

FIG. 1 illustrates an isometric view of an electrical contactor 10 formed according to an embodiment of the present invention. The contactor 10 has a box-shaped base or housing 12 having opposite side walls 14 and end walls 18. The housing 12 includes support columns 26 extending along the sidewalls 14. Terminals 22 are retained in the support columns 26. The terminals 22 have contact portions 30 and retention portions 34 that are formed with, and aligned perpendicular to, each other. The contact portions 30 for corresponding terminals 22 project inward toward one another from the support columns 26 and extend over a chamber 38 within the housing 12. The contact portions 30 have terminal contact surfaces 46 that include surfaces. The retention portions 34 are formed to be received in channels 35 in the columns 26. Contact flanges 42 extend outward from the retention portions 34 and are configured to be electrically connected to power lines. Screws 51 extend through the contact portions 30 to electrically connect the terminals 22 to other electronic components (not shown).

Each end wall 18 includes a latch 50 extending from a top end 54 thereof that is received by a latch catch in a cover piece (not shown) to retain the cover piece on the housing 12.

The chamber 38 is formed between the support columns 26. The chamber 38 retains a coil assembly 62 upon which is mounted an actuator 58. The cover piece holds the coil assembly 62 within the housing 12. The coil assembly 62 has activator terminals 90 that are electrically connected to a control line of a control unit, such as a thermostat (not shown) located in a room. Alternatively, the control unit may be a controller for a transformer, a water level sensor for a water pump, and the like. The control line sends an electrical signal to the activator terminals 90, such as when the thermostat reads a predetermined temperature in the room thereby instructing the contactor 10 to close.

The contactor 10 in FIG. 1 constitutes a two-pole contactor. Thus, the actuator 58 includes two similar halves. The actuator 58 includes a common vertical actuator post 138 with top walls 70 located at one end and bridge seats 66 located at intermediate levels along the actuator post 138. The bridge seats 66 are spaced below the top walls 70 by a desired distance and project from opposite sides of the actuator post 138. A spring 74 is located between the top wall 70 and a bridge contact 78. The spring 70 biases the bridge contact 78 downward against the bridge seat 66. The bridge contact 78 extends along a longitudinal axis 86 and is aligned as shown by the bridge seat 66. The bridge contact 78 is suspended above the contact portions 30 of the terminals 22. The bridge contact 78 has bridge contact surfaces 82 that are aligned with, the terminal contact surfaces 46 of the contact portions 30. Optionally, the actuator 58 may have only one-pole (e.g., one bridge contact 78) or more than two poles.

Figure 2:
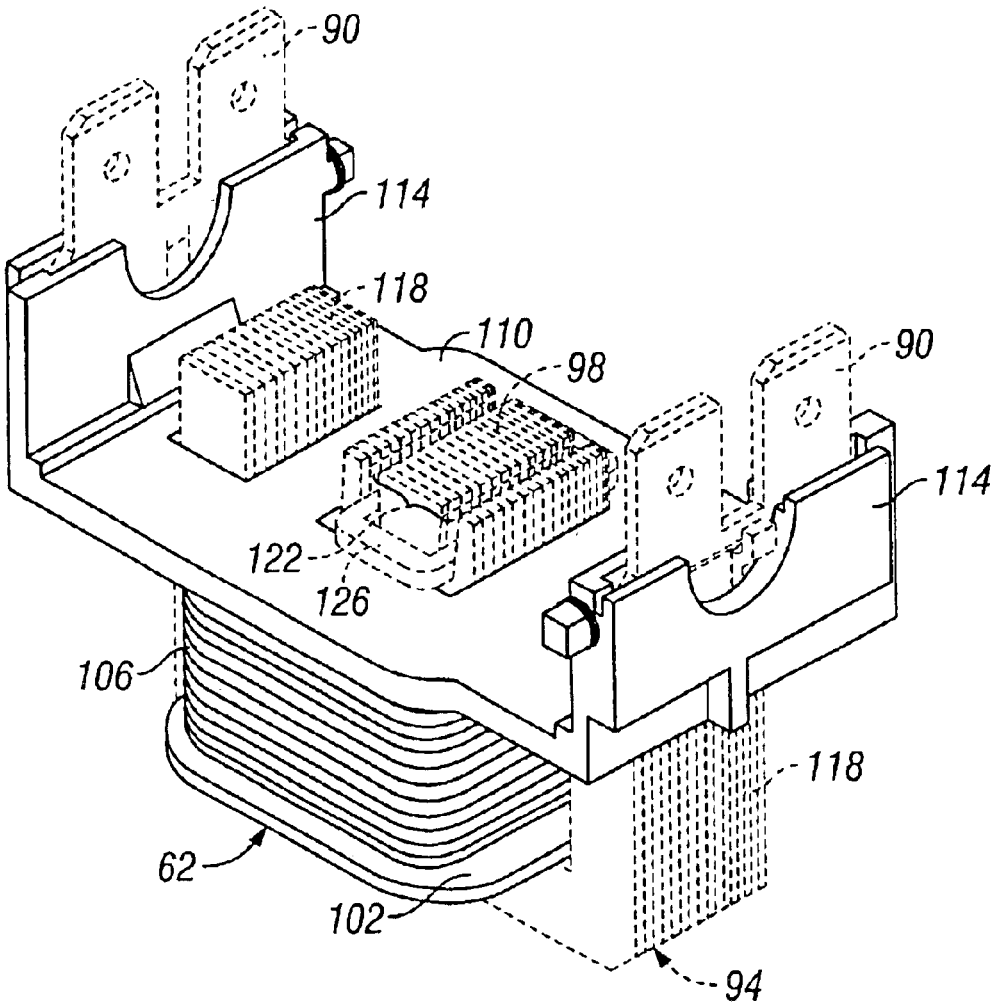
FIG. 2 illustrates an isometric view of a coil assembly and a lamination stack mounted in the contactor according to an embodiment of the present invention.

FIG. 2 illustrates an isometric view of the coil assembly 62 and a lamination stack 94 formed according to an embodiment of the present invention. The coil assembly 62 includes a bobbin 102 connected to a plastic mount 110. The mount 110 has sleeves 114 that receive the activator terminals 90. The activator terminals 90 are electrically connected to a coil 106 wrapped around the bobbin 102. The lamination stack 94 has a center post 98 located between peripheral posts 118 and contains several laminated metal layers. The center post 98 is received within the bobbin 102 and extends through the mount 110. A shading ring 126 is stacked into notches 122 in the center post 98 to retain the laminated stack 94 within the coil assembly 62. The peripheral posts 118 also extend through the mount 110. In operation, the control unit (e.g. thermostat) sends an electrical signal to the coil 106 via the activator terminals 90 to create an electromagnetic (EM) field within the coil 106. The EM field causes the actuator 58 to move from its initial open position to its final closed position.

Figure 3:
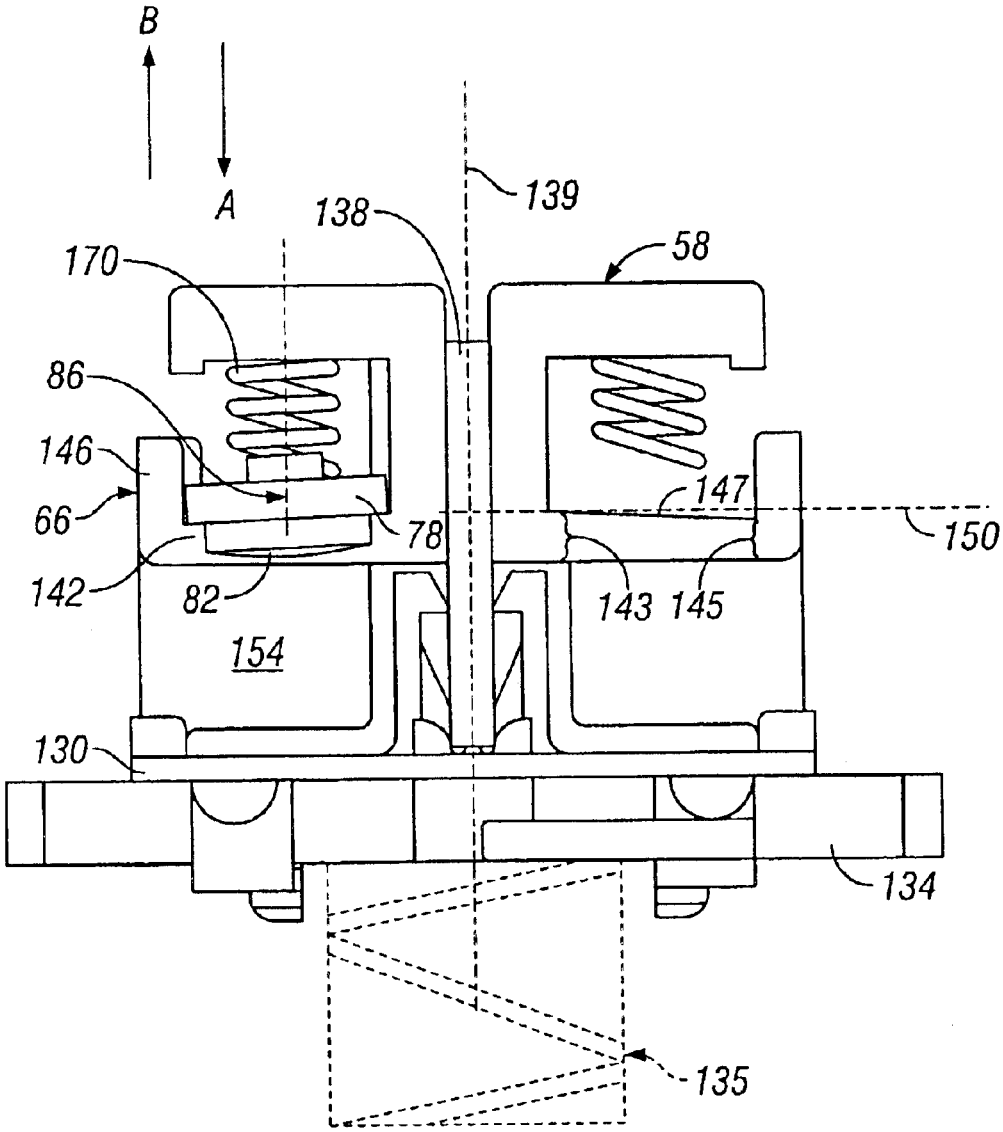
FIG. 3 illustrates a front view of an actuator from the contactor according to an embodiment of the present invention.

FIG. 3 illustrates a front view of the actuator 58 formed according to an embodiment of the present invention. The bridge seats 66 and top walls 70 are formed with, and extend transversely from, opposite sides of the actuator post 138 that is connected to, and supported by, a carrier base 130. The bridge seats 66 have contact bases 142 and retention walls 146 that retain the bridge contacts 78 in a particular location and alignment with respect to the actuator post 138 and longitudinal axis 86. The bridge seats 66 are formed with support walls 154 that extend perpendicularly from the actuator post 138 and that are connected to the contact bases 142 and the carrier base 130. The actuator post 138 moves and is oriented along a vertical axis 139. A transverse axis 150 is illustrated that extends perpendicular to the vertical axis 139. The transverse axis 150 is aligned parallel to the surface of terminal contact surfaces 46 (FIG. 1). Each contact base 142 extends from the actuator post 138 at an acute angle to the transverse axis 150. The bridge contacts 78 thus are retained between the retention walls 146 and the actuator post 138 at an acute angle to the transverse axis 150.

In FIG. 3, one bridge contact 78 has been removed to better illustrate the shape of the bridge seats 66. The contact base 142 is formed with a tapered cross-section with a thick portion 143 near the actuator post 138 and a thin portion 145 at the outer end of the contact base 142. The tapered shape of the contact base 142 forms a sloped seat surface 147 across the top of the contact base 142. Optionally, the contact base 142 may have many other shapes besides tapered, provided that the seat surface 147 that holds the bridge contact 78 at a sloped or angled orientation with respect to the plane of the surface of the terminal contact surfaces 46 (FIG. 1).

A metal I-bar 134 extends under the carrier base 130. When the actuator 58 is positioned within the chamber 38 (FIG. 1), a return spring 135 is positioned between the I-bar 134 and the mount 110 (FIG. 2) of the coil assembly 62 (FIG. 2). Returning to FIG. 1, the electro-magnetic field generated in the coil assembly 62 attracts the I-bar 134 (FIG. 3) and pulls the actuator 58 downward in the direction of arrow A further into the housing 12 such that the bridge contact surfaces 82 of the bridge contact 78 contact the terminal contact surfaces 46 of the terminals 22. When the control unit ceases sending the electrical signal to the coil assembly 62, the EM field is terminated and the actuator 58 is pushed upward in the direction of arrow B by the return spring 135 such that the bridge contact surfaces 82 no longer contact the terminal contact surfaces 46.

Figure 4:
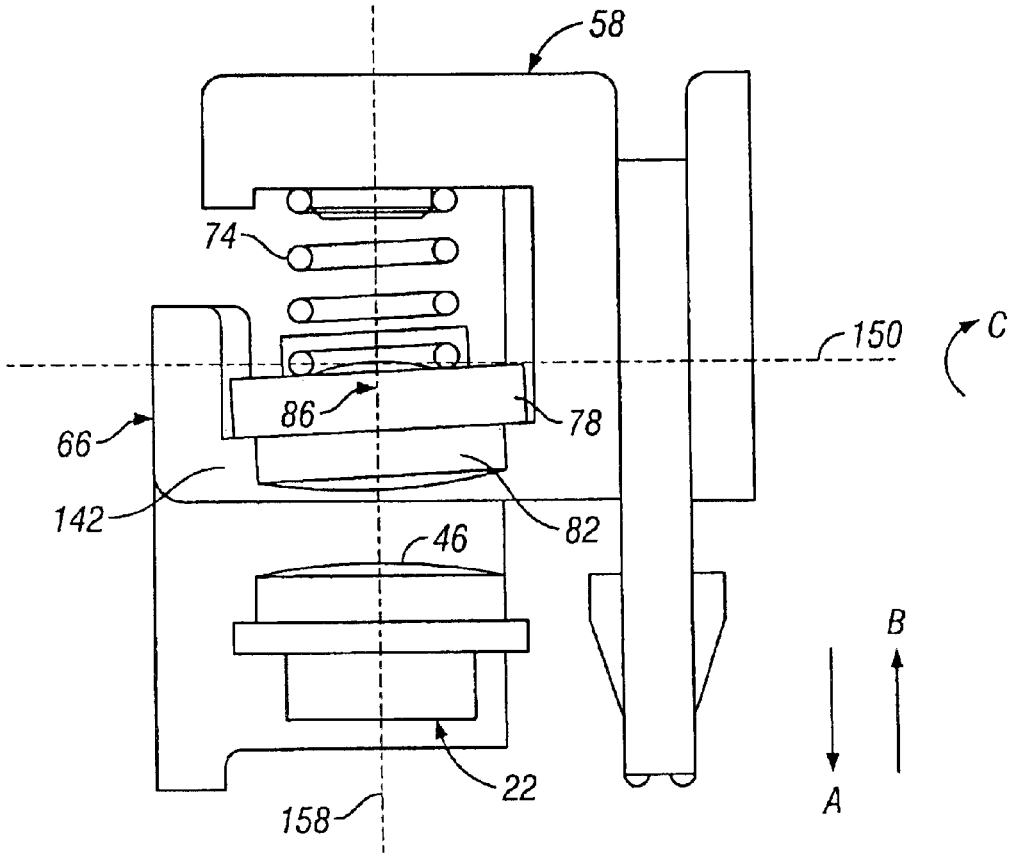
FIG. 4 illustrates a front view of a portion of an actuator and a terminal, when in an initial open position, formed according to an embodiment of the present invention.

FIG. 4 illustrates a front view of a portion of an actuator 58 and a terminal 22 in an initial open position formed according to an embodiment of the present invention. As shown, the bridge contact 78 is pressed against the contact base 142 of the bridge seat 66 by the spring 74 such that the bridge contact 78 and the bridge contact surface 82 are oriented at an acute angle to the transverse axis 150. The terminal contact surface 46 is aligned horizontal or parallel with the transverse axis 150. The bridge contact 78 and the terminal 22 are positioned in order that the bridge contact surface 82 and the terminal contact surface 46 are aligned with respect to a vertical axis 158.

In operation, when the electromagnetic field within the coil 106 (FIG. 2) attracts the I-bar 134 (FIG. 3) such that the actuator 58 is pulled downward in the direction of arrow A, the terminal contact surface 46 and the bridge contact surface 82 engage each other. Because the terminal 22 is stationary and the bridge contact 78 is biased against the contact base 142 through the spring 74, the terminal contact surface 46 resists the bridge contact surface 82 and therein, the bridge contact surface 82 compresses the spring 74 as the actuator 58 continues to move in the direction of arrow A. The bridge contact 78 separates from the contact base 142, which in turn permits the bridge contact 78 to float and rotate about longitudinal axis 86. When the bridge contact surface 82 and terminal contact surface 46 initially touch one another, they are oriented within separate and distinct non-parallel contact planes that intersect one another at an acute angle.

Figure 5:
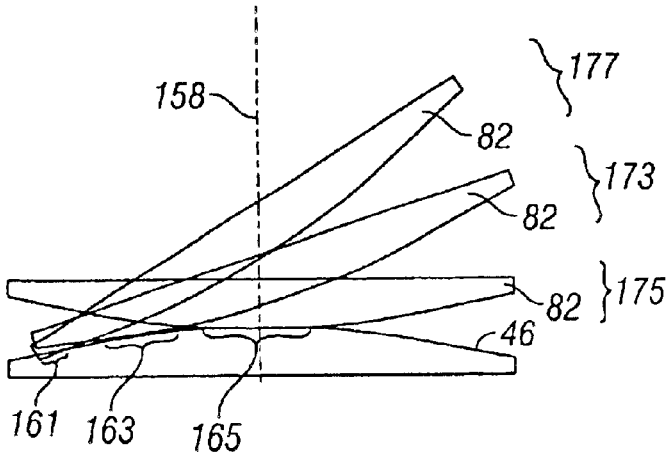
FIG. 5 illustrates a graphical representation of the positions and orientation of a bridge contact surface and terminal contact surface at various stages during engagement.
Figure 6:
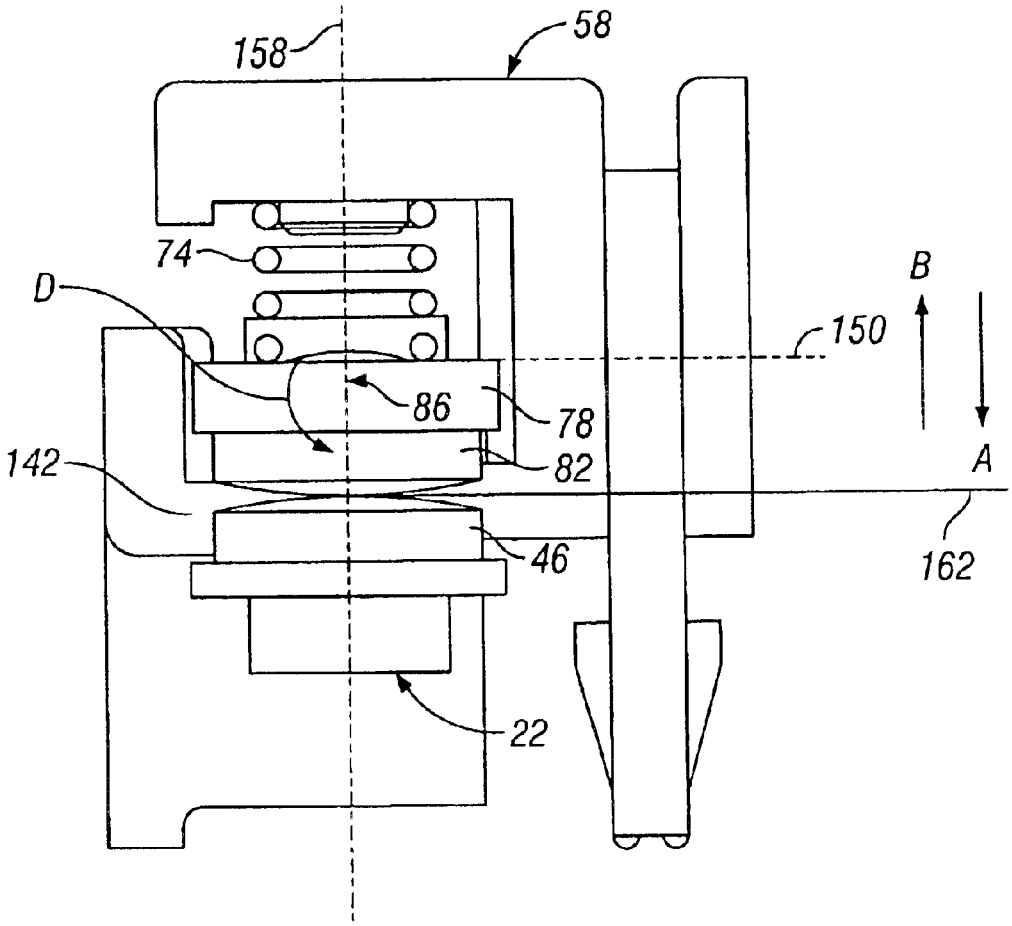
FIG. 6 illustrates a front view of a portion of an actuator and a terminal, when in a final closed position, formed according to an embodiment of the present invention.

FIG. 5 illustrates a graphical representation of the positions and orientations of the bridge contact surface 82 and terminal contact surface 46 at various stages during engagement (e.g. while reaching the final closed position). FIG. 6 illustrates the terminal contact surface 46 oriented perpendicular to the vertical axis 158. As the bridge contact 78 (FIG. 4) is brought into an initial point of engagement with the terminal 22, an end portion 161 of the bridge contact surface 82 is all that engages the terminal contact surface 46. An exemplary relation between the bridge contact surface 82 and the terminal contact surface 46 when in this initial engagement stage is indicated at 177. Numbers 173 and 175 similarly illustrate orientations between the bridge contact surface 82 and the terminal contact surface 46 when at subsequent engagement stages. When at an intermediate engagement stage 173, a portion 163 of the terminal contact surface 46 is in contact with the bridge contact surface 82. When at a final engagement stage 175, portion 165 of the terminal contact surface 46 and bridge contact surface 82 contact one another. Hence, the point of contact between the bridge and terminal contact surfaces 82 and 46 moves during the engagement process from outer portion 161 to a central portion 165, thereby reducing the likelihood of welding between the terminal and bridge contact surfaces 46 and 82 and assisting in the breaking of tack welds therebetween.

As more clearly shown in FIG. 5, the terminal and bridge contact surfaces 46 and 82 may be curved to facilitate movement of t he point of contact from portion 161 toward portion 165. Optionally, one or both of the bridge contact surfaces 46 and 82 may be planar.

FIG. 6 illustrates a front view of a portion of an actuator 58 and a terminal 22 in a final closed position formed according to an embodiment of the present invention. After the bridge contact 78 has been resistibly separated from the contact base 142, the bridge contact surface 82 and the terminal contact surface 46 are completely engaged to define a final contact engagement plane 162 that is parallel to the transverse axis 150. When the control unit sending the electrical signal to the coil assembly 62 (FIG. 2) no longer sends a control signal, the actuator 58 is pushed upward in the direction of arrow B by the compressed return spring 135 (FIG. 3). As the actuator 58 moves upward in the direction of arrow B, the spring 74 pushes the bridge contact 78 downward until resting upon the contact base 142. As the bridge contact 78 engages the contact base 142, the bridge contact 78, and thus the bridge contact surface 82, rotate in the direction of arrow D about the longitudinal axis 86 (extending out from the page in FIG. 6) until the bridge contact 78 and the bridge contact surface 82 are fully seated in the contact base 142 at an acute angle to the transverse axis 150. As the bridge contact surface 82 rotates in the direction of arrow D, the bridge contact surface 82 rolls across the terminal contact surface 46 until being pulled upward in the direction of arrow B away from the terminal contact surface 46.

When the bridge contact surface 82 and the terminal contact surface 46 engage each other, an electrical arc is drawn between the bridge contact surface 82 and the terminal contact surface 46. The rolling action of the bridge contact surface 82 against the terminal contact surface 46 during engagement reduces the likelihood that the arc will weld the bridge contact surface 82 and the terminal contact surface 46 to each other. The rolling action helps extend the life of the bridge contact surface 82 and the terminal contact surface 46 by reducing the frequency of welds forming therebetween.

Similarly, the rolling action may assist in breaking a weld that forms between the bridge contact surface 82 and the terminal contact surface 46 during connection. The rolling action is better able to break a weld than simply by pulling the bridge contact surface 82 and terminal contact surface 46 away from each other along the vertical axis 158 because the rolling action introduces peel forces that help pull the weld apart in multiple directions, not just along the vertical axis 158. Thus the rolling action that occurs during separation also extends the life of the bridge contact surface 82 and the terminal contact surface 46.

Figure 7:
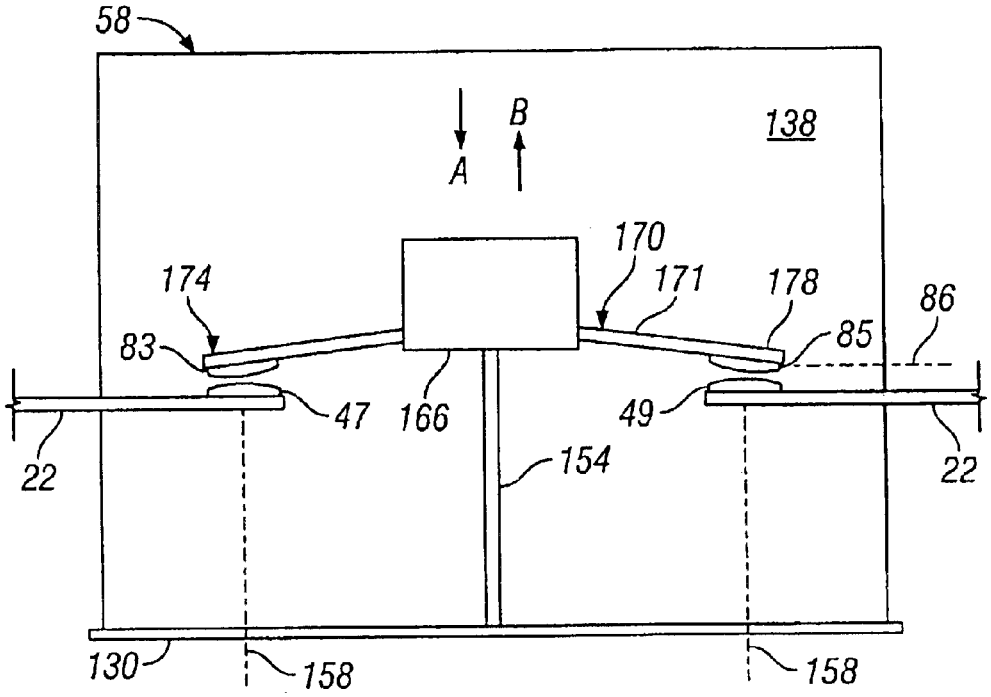
FIG. 7 illustrates a side view of a portion of an actuator and portions of terminals, when in an initial open position, formed according to an alternative embodiment of the present invention.

FIG. 7 illustrates a side view of a portion of an actuator 58 and portions of terminals 22, when in an initial open position, formed according to an alternative embodiment of the present invention. A bridge base 166 is supported by the support wall 154 with both extending perpendicularly from the actuator post 138. The support wall 154 and the actuator post 138 both extend perpendicularly from the carrier base 130. The bridge base 166 is formed with a curved, flexible bridge contact 170 having a flexible intermediate portion 171 with a bridge contact surface 83 at a first end 174 and a bridge contact surface 85 at a second end 178 of the flexible intermediate portion 171. The bridge contact 170 and the terminals 22 are positioned in order that the bridge contact surfaces 83 and 85 are aligned with terminal contact surfaces 47 and 49, respectively, of the terminals 22 along the vertical axes 158.

In operation, when the electromagnetic field within the coil 106 (FIG. 2) attracts the I-bar 134 (FIG. 3) such that the actuator 58 is pulled downward in the direction of arrow A, the terminal contact surfaces 47 and 49 engage the bridge contact surfaces 83 and 85, respectively, of the bridge contact 170. Because the terminals 22 are stationary and the bridge contact 170 is flexible, the terminal contact surfaces 47 and 49 resist further downward movement of the bridge contact surfaces 83 and 85, respectively.

Figure 8:
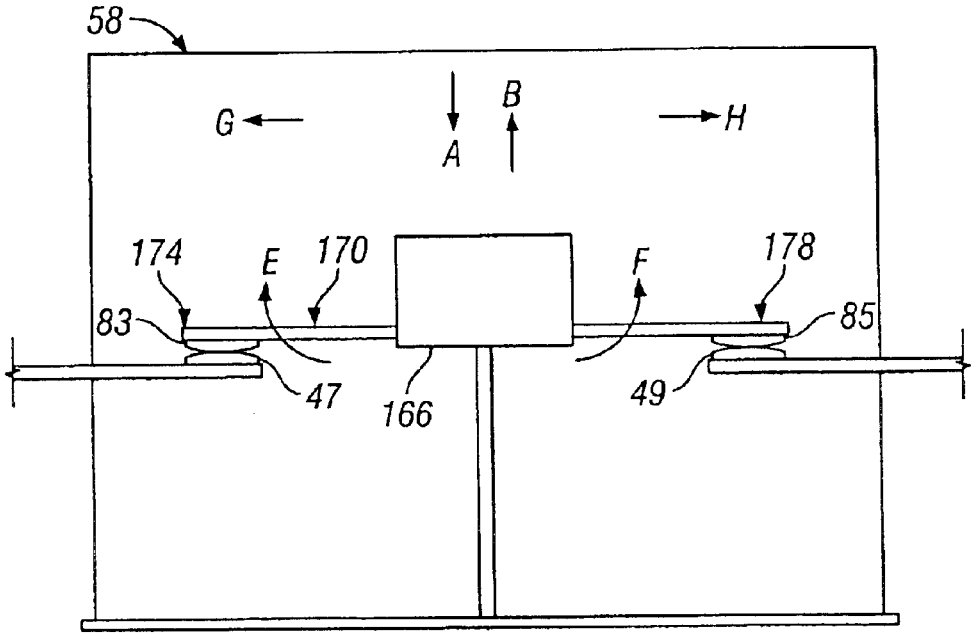
FIG. 8 illustrates a side view of the actuator and the terminal portions of FIG. 7, when in a final closed position.

As shown in FIG. 8, as the bridge contact surfaces 83 and 85 are held against further vertical motion while the bridge base 166 continues to move downward, the bridge contact 170 is flattened out into a more planar alignment. The first and second ends 174 and 178 are flexed in the direction of arrows E and F, respectively. Hence, the bridge contact surface 83 slides or linearly translates along the terminal contact surface 47 in the direction of arrow G, and the bridge contact surface 85 slides or linearly translates along the terminal contact surface 49 in the direction of arrow H.

During disengagement, when the actuator 58 moves upward in the direction of arrow B and the bridge contact surfaces 83 and 85 pull away from the terminal contact surfaces 47 and 49, the bridge contact 170 returns to its initial curved shape. As the first end 174 flexes in the direction opposite to arrow E, the contact surface 83 slides or linearly translates in the direction opposite to arrow G. Likewise, as the second end 178 flexes in the direction opposite to arrow F, the contact surface 85 slides or linearly translates in the direction opposite to arrow H.

Figure 9:
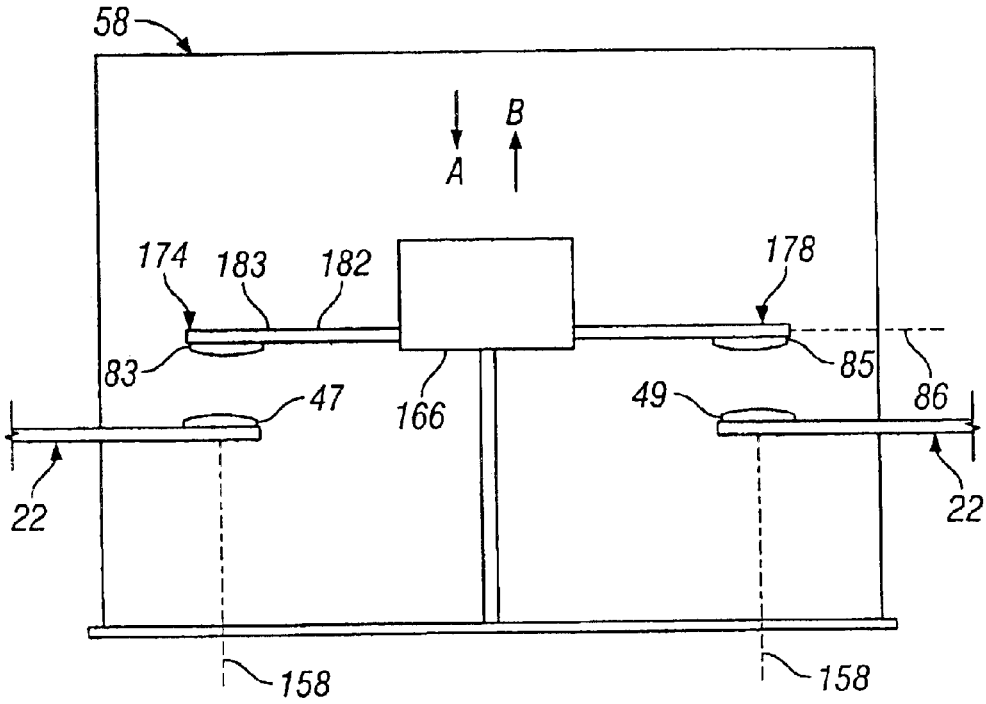
FIG. 9 illustrates a side view of a portion of an actuator and portions of terminals, when in an initial open position, formed according to an alternative embodiment of the present invention.

FIG. 9 illustrates a side view of a portion of an actuator 58 and portions of terminals 22, when in an initial open position, formed according to an alternative embodiment of the present invention. The bridge base 166 is formed with a flat, flexible bridge contact 182 having a flexible intermediate portion 183 with the bridge contact surface 83 at the first end 174 and the bridge contact surface 85 at the second end 178. The bridge contact 182 and the terminals 22 are positioned in order that the bridge contact surfaces 83 and 85 are aligned with the terminal contact surfaces 47 and 49, respectively, of the terminals 22 along the vertical axes 158.

In operation, when the actuator 58 is pulled downward in the direction of arrow A, the terminal contact surfaces 47 and 49 engage the bridge contact surfaces 83 and 85, respectively, of the bridge contact 182. Because the terminals 22 are stationary and the bridge contact 182 is flexible, the terminal contact surfaces 47 and 49 resist further downward movement of the bridge contact surfaces 83 and 85, respectively.

Figure 10:
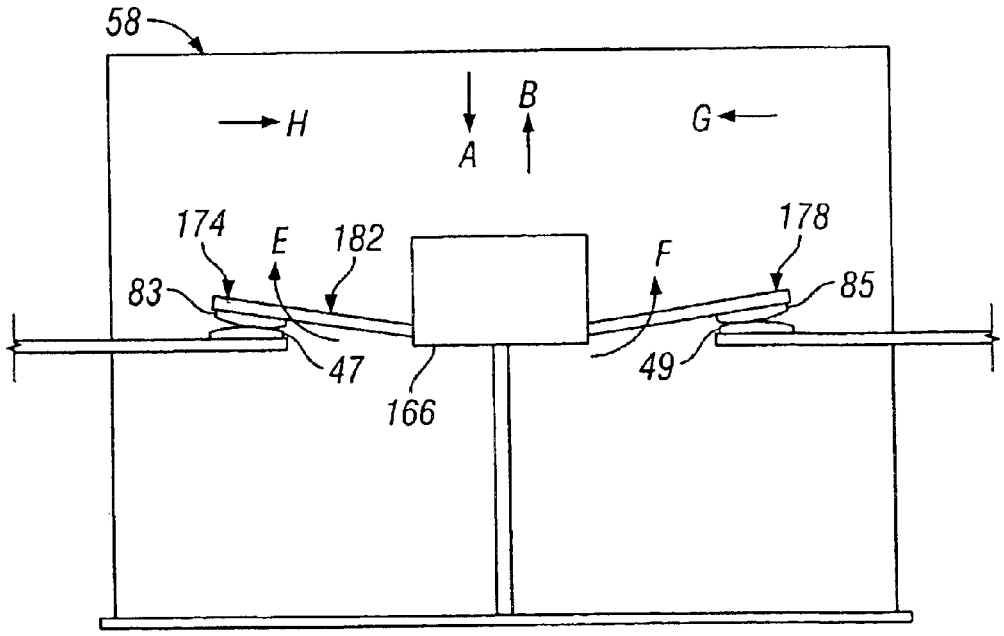
FIG. 10 illustrates a side view of the actuator and the terminal portions of FIG. 7, when in a final closed position.

As shown in FIG. 10, as the bridge contact surfaces 83 and 85 are held against further vertical motion while the bridge base 166 continues to move downward, the bridge contact 182 is bowed about the bridge base 166 into a curved shape. The first and second ends 174 and 178 are flexed in the direction of arrows E and F, respectively. Hence, the bridge contact surface 83 slides or linearly translates along the terminal contact surface 47 in the direction of arrow H, and the bridge contact surface 85 slides or linearly translated along the terminal contact surfaces 49 in the direction of arrow G.

During disengagement, when the actuator 58 moves upward in the direction of arrow B and the bridge contact surfaces 83 and 85 pull away from the terminal contact surfaces 47 and 49, the bridge contact 182 returns to its initial flat shape. As the first end 174 flexes in the direction opposite to arrow E, the bridge contact surface 83 slides or linearly translates in the direction of arrow G. Likewise, as the second end 178 flexes in the direction opposite to arrow F, the bridge contact surface 85 slides or linearly translates in the direction of arrow H.

In the embodiments of FIGS. 6–10, the linear translation of the bridge contact surfaces 83 and 85 along the terminal contact surfaces 47 and 49, respectively, during engagement reduces the likelihood that the bridge contact surfaces 83 and 85 will be welded to the terminal contact surfaces 47 and 49, respectively. Welds are less likely to form when the bridge contact surfaces 83 and 85 are engaged in sliding contact with the terminal contact surfaces 47 and 49, respectively, along the longitudinal axis 86, as opposed to being engaged only along the vertical axes 158. Additionally, the linear translation of the bridge contact surfaces 83 and 85 along the terminal contact surfaces 47 and 49, respectively, during disengagement breaks welds because shear forces along with forces along the vertical axes 158 are used to break the weld. The linear translation thus helps improve the use life of the bridge contact surfaces 83 and 85 and the terminal contact surfaces 47 and 49.

While the invention has been described with reference to certain embodiments, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiment disclosed, but that the invention will include all embodiments falling within the scope of the appended claims.

What is claimed is:

1. A contactor assembly comprising:

a base;

power terminals mounted to said base that are configured to convey power signals;

an actuator movably mounted to said base, said actuator being movable between initial and final positions along a first direction of motion; and at least one bridge contact supported by said actuator and moved in said first direction of motion with said actuator, said bridge contact including bridge contact surfaces on opposite ends thereof aligned with corresponding power terminals, said bridge contact surfaces engaging said power terminals when said actuator and bridge contact are moved to said final position, said bridge contact moving in a second direction of motion with respect to said actuator, said second direction of motion differing from said first direction of motion during engagement; wherein said actuator includes a sloped bridge seat supporting said bridge contact, said bridge seat being oriented at an acute angle to said first direction of motion, said bridge seat tilting said bridge contact with respect to said power terminals in order that said bridge contact rotates during engagement with said power terminals.

2. The contactor assembly of claim 1, wherein said second direction of motion includes rotation about a longitudinal axis of said bridge contact.

3. The contactor assembly of claim 1, further comprising an actuator carrier slidably supporting said actuator when moving in said first direction of motion, said actuator moving upward and downward within said base.

4. The contactor assembly of claim 1, further comprising at least one spring for biasing said actuator toward said initial position.

5. The contactor assembly of claim 1, further comprising a coil assembly drawing said actuator into said final position.

6. The contactor assembly of claim 1, further comprising a spring mounted between said bridge contact and said actuator to maintain said bridge contact at a first orientation with respect to said actuator when in said initial position, said spring permitting said bridge contact to rotate to a second orientation with respect to said actuator when in said final position.

7. The contactor assembly of claim 1, wherein said bridge contact is initially supported by said actuator at a first orientation with respect to said actuator when in said initial position, said bridge contact rotating to a second orientation with respect to said actuator when in said final position.

8. The contactor assembly of claim 1, wherein said actuator includes an I-bar that is electromagnetically attracted to a coil assembly within said base, said I-bar pulling said actuator from said initial position to said final position.

9. The contactor assembly of claim 1, wherein said power terminals include terminal contact surfaces having a central portion defining a final engagement plane, said bridge contact being oriented at an acute angle to said final engagement plane when in said initial position, said bridge contact rotating to be parallel to said final engagement plane when in said final position.

10. A contactor assembly comprising:

a base;

power terminals mounted to said base that are configured to convey power signals;

an actuator movably mounted to said base, said actuator being movable between initial and final positions along an actuator axis; and at least one bridge contact supported by said actuator and moved along said actuator axis with said actuator, said bridge contact extending along a longitudinal axis and including bridge contact surfaces at opposite ends of said longitudinal axis, said bridge contact surfaces aligning with corresponding power terminals, said bridge contact surfaces engaging and interconnecting said power terminals when said actuator and bridge contact are moved to said final position, said bridge contact rotating about said longitudinal axis such that points of contact between said power terminals and bridge contact surfaces move along said bridge contact surfaces during engagement; wherein said actuator includes a sloped bridge seat supporting said bridge contact, said bridge seat being oriented at an acute angle to said actuator axis, said bridge seat tilting said bridge contact with respect to said power terminals in order that said bridge contact rotates during engagement with said power terminals.

11. The contactor assembly of claim 10, further comprising an actuator carrier slidably supporting said actuator when moving between said initial and final positions, said actuator moving upward and downward within said base.

12. The contactor assembly of claim 10, further comprising at least one spring for biasing said actuator toward said initial position.

13. The contactor assembly of claim 10, further comprising a coil assembly drawing said actuator into said final position.

14. The contactor assembly of claim 10, further comprising a spring mounted between said bridge contact and said actuator to maintain said bridge contact at a first orientation with respect to said actuator when in said initial position, said spring permitting said bridge contact to rotate to a second orientation with respect to said actuator when in said final position.

15. The contactor assembly of claim 10, wherein said bridge contact is initially supported by said actuator at a first orientation with respect to said actuator when in said initial position, said bridge contact rotating to a second orientation with respect to said actuator when in said final position.

16. The contactor assembly of claim 10, wherein said power terminals include terminal contact surfaces having a central portion defining a final engagement plane, said bridge contact being oriented at an acute angle to said final engagement plane when in said initial position, said bridge contact rotating to be parallel to said final engagement plane when in said final position.

17. The contactor assembly of claim 10, wherein said actuator includes an I-bar that is electromagnetically attracted to a coil assembly within said bases said I-bar pulling said actuator from said initial position to said final position.

* * * * *